US010618616B2

(12) United States Patent
Horrigan

(10) Patent No.: US 10,618,616 B2
(45) Date of Patent: Apr. 14, 2020

(54) PROPELLING OBJECTS USING A CAUDAL CYCLE

(71) Applicant: HORRIGAN CORPORATION, Encinitas, CA (US)

(72) Inventor: David John Horrigan, Encinitas, CA (US)

(73) Assignee: Horrigan Corporation, Encinitas, CA (US)

( * ) Notice: Subject to any disclaimer, the term of this patent is extended or adjusted under 35 U.S.C. 154(b) by 112 days.

(21) Appl. No.: 14/904,069

(22) PCT Filed: Jul. 9, 2014

(86) PCT No.: PCT/US2014/046057

§ 371 (c)(1),
(2) Date: Jan. 8, 2016

(87) PCT Pub. No.: WO2015/006514

PCT Pub. Date: Jan. 15, 2015

(65) Prior Publication Data

US 2016/0152309 A1 Jun. 2, 2016

Related U.S. Application Data

(60) Provisional application No. 61/844,315, filed on Jul. 9, 2013.

(51) Int. Cl.
*B63H 1/36* (2006.01)

(52) U.S. Cl.
CPC ..... *B63H 1/36* (2013.01)

(58) Field of Classification Search
CPC ..... B63H 1/36; B63H 1/30
See application file for complete search history.

(56) References Cited

U.S. PATENT DOCUMENTS 4,793,386 A * 12/1988 Sloan ..... E03F 7/10 137/351
5,401,196 A 3/1995 Triantafyllou
(Continued)

FOREIGN PATENT DOCUMENTS

DE 2446964 A1 4/1976
JP 05-180199 A 7/1993
(Continued)

OTHER PUBLICATIONS

International Search report as issued in International Patent Application No. PCT/US2014/046057, dated Oct. 27, 2016; 2 pages.
(Continued)

*Primary Examiner* — Woody A Lee, Jr.
*Assistant Examiner* — Michael L Sehn
(74) *Attorney, Agent, or Firm* — Pillsbury Winthrop Shaw Pittman LLP

(57) ABSTRACT

The present invention is a device and method of using the device for moving gases or liquids from one location to another. The device has at least one planar rigid blade; a crank for each planar rigid blade having two apertures the first able to receive a drive shaft and the second positioned a distance away from the first; a connecting rod for each crank affixed to the rigid blade on one end and to the second aperture of the crank; an encasement having at least one opening to receive the connecting rod; and a pivot bearing affixed within each opening through which a connecting rod passes.

19 Claims, 6 Drawing Sheets

(56) References Cited

U.S. PATENT DOCUMENTS

| | | | | |
|---|---|---|---|---|
| 5,890,875 | A * | 4/1999 | Silvano | A63H 33/40<br>228/144 |
| 6,193,466 | B1 * | 2/2001 | Earl | B63H 1/08<br>416/128 |
| 7,874,882 | B2 | 1/2011 | Sagov | |
| 2008/0253896 | A1 * | 10/2008 | Walls | F04D 19/005<br>416/223 R |

FOREIGN PATENT DOCUMENTS

| | | | |
|---|---|---|---|
| JP | 2001163296 | A | 6/2001 |
| JP | 2011250674 | A | 12/2011 |
| WO | 199748599 | | 12/1997 |

OTHER PUBLICATIONS

Japanese Intellectual Property Office, Office Action in Japanese Patent Application No. 2016-525469, dated May 22, 2018, pp. 1-9.
Japanese Intellectual Property Office, Office Action issued in Japanese Patent Application No. 2016-525469, dated Aug. 27, 2019, pp. 1-4.

* cited by examiner

PROPELLING OBJECTS USING A CAUDAL CYCLE

CROSS-REFERENCE TO RELATED APPLICATIONS

This application is the U.S. National Stage of PCT/US2014/0460574, filed Jul. 9, 2014, which in turn claims priority to U.S. Provisional patent Application No. 61/844315 filed Jul. 9, 2013. The content of these applications are incorporated herein by reference in their entireties.

STATEMENT REGARDING FEDERALLY SPONSORED RESEARCH OR DEVELOPMENT

None

INCORPORATION-BY-REFERENCE OF MATERIAL SUBMITTED ON COMPACT DISC

None

BACKGROUND OF THE INVENTION (1) Field of the Invention

The present invention relates to fans, pumps and propellers. More specifically, the invention provides methods and devices that utilize a caudal cycle to move gas or liquid from one location to another or that propel a craft through gas such as air or liquid such as water.

(2) Description of Related Art

Many marine fishes and mammals move through the water by the motion of their fins in a caudal cycle. This cycle has been harnessed by a variety of devices to move liquids and gases but none of these inventions come close to matching or exceeding the performance and efficiency demonstrated in nature.

The caudal cycle describes the movement of a propulsive surface, such as a caudal fin, so that it maximizes forward thrust while minimizing reverse thrust and drag. Two commonly recognized cycle types are the natural caudal cycle and the mechanical caudal cycle. Marine mammals and some fish use their caudal fin to perform the natural caudal cycle for propulsion. This is very different from other fins used for hovering or precision movement similar to the oscillations of the pectoral fins or the flexions of the dorsal fin used for steering, counter thrusting and twisting. The natural caudal fin in a marine environment has evolved to be highly reformable to suit the mammal or fish's needs under different conditions and is used to sense pressure variations, turbulence, speed and power loading. The fin can frequently become thinner and change its chord section to conform to reduce vortices coming from its trailing edge. The natural caudal cycle is driven by the leading edge and the blade component is mostly rigid and the trailing edge is positioned by the leading edge/tail pivot joint. To avoid undue turbulence the natural cycle is predominantly a pushing operation.

In the natural caudal cycle, the leading edge is oscillated from one side of the cycle extreme to the other relative to the speed of the water flow. The fin is then pivoted following the leading edge towards its direction of travel, pushing the water aft and the fish forward. This cycle is repeated with shallower cycles as speed increases.

The mechanical cycle is essentially the same as the natural caudal cycle, but has a longer thrust and coarse angle of attack at slow speed and a shallower thrust and angle of attack at high speed. In the mechanical caudal cycle, the leading edge is positioned toward the extreme off center of cycle, with the blade forming an ideal angle of attack for the blade. Maintaining this angle of attack the blade is thrust as far as it will go in that direction. The leading edge is stopped while the trailing edge is thrust to a position following the leading edge and parallel to the flow of the fluid. The leading edge is positioned toward the other extreme side of the cycle forming an ideal angle of attack for the blade. Maintaining this angle of attack the blade is thrust as far as it will go in that direction. The leading edge is stopped while the trailing edge is thrust to a position following the leading edge and parallel to the flow of the fluid. This cycle is then repeated.

U.S. Pat. No. 5,054,376 to Sanchez discloses a mechanical version of the natural caudal cycle used for moving air. However, the undriven trailing edge and non-rigid blade limits the force that can be directed toward driving the air and most of the blade surface provides only drag into the stream.

U.S. Pat. No. 5,401,196 to Triantafyllou et al. discloses an example of the mechanical caudal cycle in a ship-propelling device. However, this system is complex and has many parts susceptible to failure and its performance is limited compared to traditional propellers and their equivalents.

Therefore, there is a need in the field of fluid motion for an improved caudal cycle that can deliver better performance and reliability.

BRIEF SUMMARY OF THE INVENTION

The present invention is a device and method of using the device for moving gases or liquids from one location to another. In one aspect, the device has an encasement, at least one planar rigid blade, crank, connecting rod and pivot bearing. The crank has two apertures, the first able to receive a drive shaft and the second positioned a distance away from the first. The connecting rod is affixed to the rigid blade on one end and to the second aperture of the crank on the other. The encasement or base may have at least one opening to receive the connecting rod. The pivot bearing is affixed within the opening through which the connecting rod passes into the encasement.

In one embodiment the drive shaft is the drive shaft of a motor. Alternatively, the device further comprises a motor having a drive shaft.

In another embodiment the encasement or base is a gas or liquid conduit. Alternatively, the encasement contains the motor, crank and a portion of the connecting rod affixed to the crank.

In another aspect, a method is provided for moving gas or liquid with the device. In one embodiment the device has an encasement, motor and at least one flat rigid blade, crank, connecting rod and pivot bearing. There is a crank for each flat rigid blade having a first and second apertures. The motor has a drive shaft affixed to the first aperture of the crank. There is a connecting rod for each flat rigid blade. One end of each connecting rod is affixed to the center of the flat rigid blade and the other end affixed to the second aperture of the crank. The encasement has one opening for each connecting rod and a pivot bearing affixed within each opening through which the connecting rod passes. The method comprises the steps of inserting the flat rigid blade into a gas or liquid and activating the motor.

In one embodiment of this aspect of the invention, the encasement is a gas or fluid conduit into which the flat rigid blade extends. Alternatively, the encasement is a housing that encases the motor, the crank and the portion of the connecting rod affixed to the crank.

DETAILED DESCRIPTION OF THE INVENTION

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "affixed" as used herein refers to the interaction between the blade and the connecting rod and the connecting rod and the crank. In the case of the blade and the connecting rod, the connection may be static or dynamic. In the case of the connecting rod and the crank, the connection is dynamic. For example, where the motion is circular the connecting rod is rotatably affixed to the crank.

The term "motor" as used herein may be any device having a drive shaft able to provide rotational energy to activate and run the one or more blades of the device.

The term "encasement" as used herein refers to a conduit through which gas or liquid passes. Alternatively, the encasement can be an enclosure, which encases the motor, crank and a portion of the connecting rod. In the case where the blade is moving gas or fluid in a restricted area such as a conduit, the encasement is the restricted area. In such an example, the motor is preferably mounted on the exterior of the conduit and the blade and a portion of the connecting rod extends into the conduit where the gas or fluid resides. In the case where the blade is being used to propel the device through a gas or fluid, the encasement is an enclosure housing the motor, crank and a portion of the connecting rod and remaining portion of the connecting rod and the blade are exposed to the environment on the exterior of the encasement.

Figure 2:
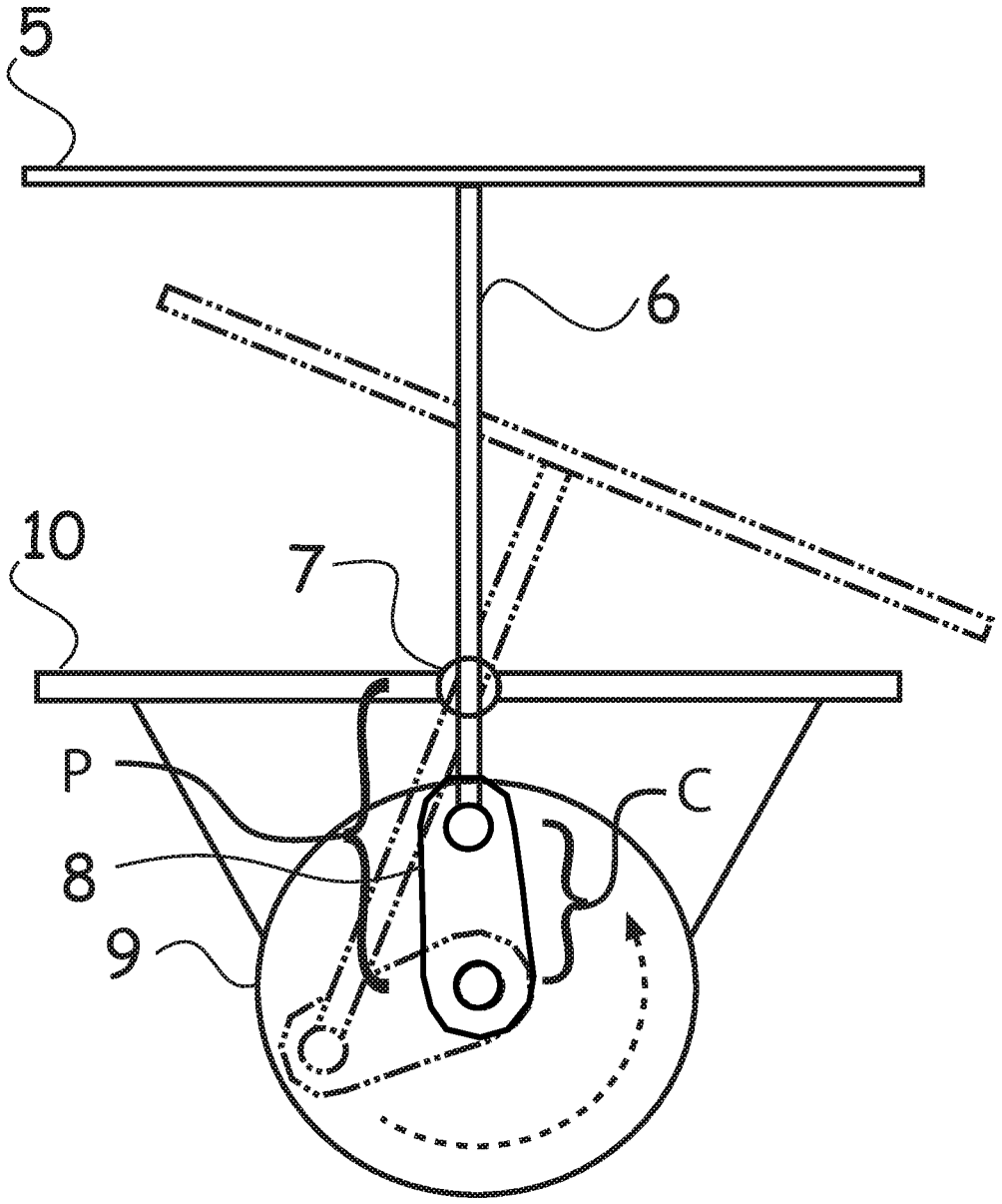
FIG. 2 is a diagrammatic representation of the position of the blade in the simplified caudal cycle.

In one aspect of the present invention, the device and methods utilize a simplified caudal cycle. In the simplified caudal cycle, the blade path is determined by the distance the connecting rod is mounted from the crank center (C) and the distance the pivot bearing is from the crank center (P) (FIG. 2). A greater distance for C gives a greater angle of attack and thus greater acceleration but lesser maximum fluid flow. A greater distance for P gives a lesser angle of attack and thus lesser acceleration but greater fluid speed. In the simplified caudal cycle the blade is thrust away from the crank causing the blade to form a varying ark and varying angle of attack until it reaches the extreme out-thrust point. At this point, the fluid is deflected in the same direction as the crank rotation. The blade is then pulled toward the crank causing the blade to form a varying ark and varying angle of attack until it reaches the extreme in-thrust point. At this point, the fluid is deflected away from the center point in the same direction as the crank rotation.

In another aspect of the present invention, the device and methods utilize a mechanical caudal cycle and a flat planar blade to drive the fluid or gas. This is unique from previous devices in that the blade is not a foil but merely a flat planer blade.

The Blade

The blade 5 (FIG. 1) is a flat rigid plate, though it can be of corrugated or assembled structure provided the top and bottom surfaces are parallel and the thickness minimized to prevent drag while maintaining rigidity. The present flat, rigid blade 5 is different from a traditional blade because it is not fared or foil-shaped which impedes duty cycle and contributes to shedding vortices in the exhaust flow, diminishing performance. Blade 5 may be sized so that the width of the blade is the desired width of the stream to be propelled. The fore and aft length of the blade 5 may be sized as to be relative to the acceleration load needed to get the fluid or gas up to speed, the ultimate desired speed of the fluid and the power introduced into the blade 5. For example, a six-inch wide blade used in propelling fluid may be from one to three inches long (fore and aft). A blade length of one inch for low-mass fluids accelerated to a high speed. A two-inch blade length for accelerating higher mass fluids to a medium speed and a three-inch blade length for a viscous fluid intended to be moved a lower speed. Standard propeller design theory applies here in that longer width, slower speed and thinner (or shorter fore & aft length) makes for more efficiency. The blade 5 could be scaled up or down from macro applications for moving air on circuit boards to accelerating rivers or canals or even accelerating air through a valley.

The blade's 5 purpose is to transfer directional energy into the fluid or air either as a driving device such as a propeller or as a pumping or fan-like device. It can be constructed from any rigid material that will withstand the deflective, flexural and cyclical forces of operation, as well as the demands of the environment in which it will operate (i.e. effect of corrosion, heat, and blade impact from fluid contaminants). Types of material include, for example, bronze, aluminum, carbon fiber, rigid plastic or steel plate.

Common knowledge of those skilled in the art familiar with propeller design would fair or taper the blade 5. However, the present invention has unexpectedly found that this restricts fluid flow and should be avoided. Any taper in the blade 5 form will produce shedding vortices from the low pressure side of the blade causing increased power use as well as restricted fluid flow. Consequently, the leading and trailing edges of blade 5 are bluff to avoid fairing of the parallel blade surfaces. In exceptionally thick blades the leading edge may be rounded if the blade is to be positioned parallel to the flow for extended periods.

The driving surfaces may be grooved lengthwise to increase surface area over a given length, dimpled with micro dimples to improve drag characteristics or treated with coatings that are omniphobic to reduce friction by reducing the amount of water that sticks to the blade as it moves through the water.

Blade 5 is affixed to the distal end of crank connecting rod 6 by a variety of methods known in the art and will depend on the application, operating environment and/or size. The factors considered include the ability to securely hold blade 5 rigid on its primary plane, resistance to hitting foreign objects and ease of effort in replacing damaged or worn blades. Large blades fabricated from steel plates may have a broad pad that may be welded to the connecting rod whereas smaller carbon fiber blades may be mounted through a support pad washer to a broadened connecting rod end. Dovetail connections, glued rib structures and integrated groves that provide additional support for the blade may also be utilized for mounting.

The Crank Arm

Figure 1:
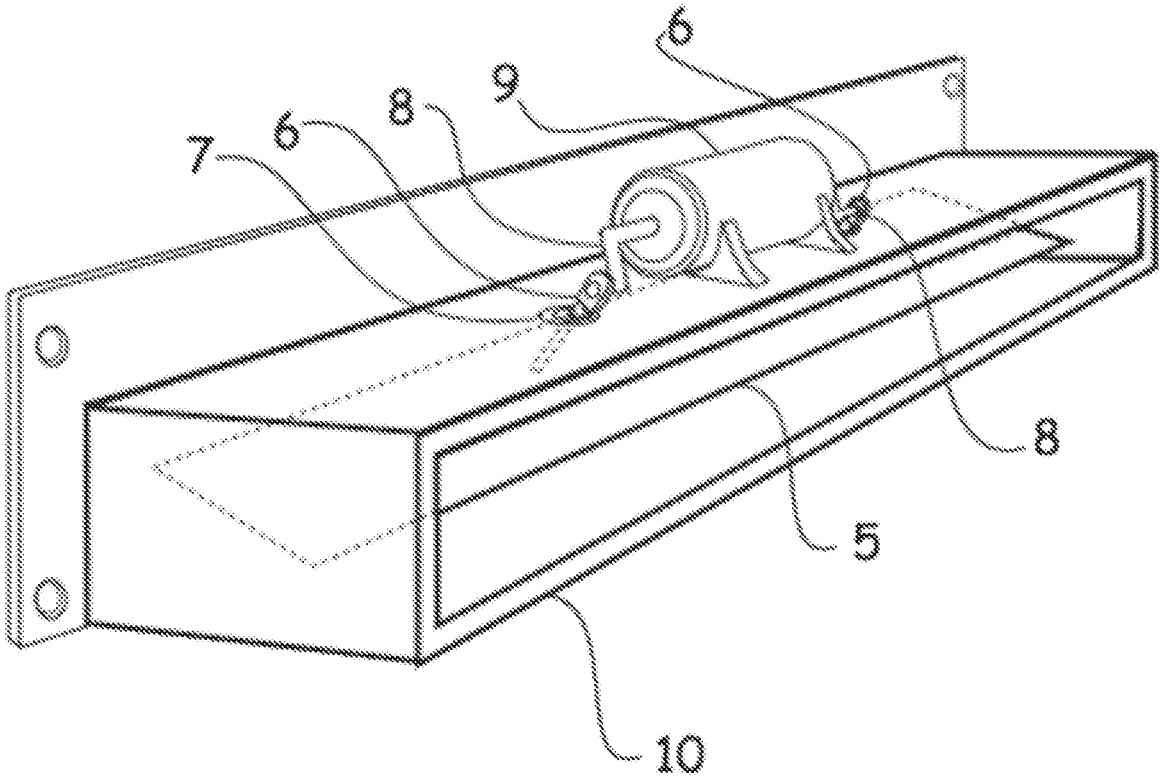
FIG. 1 is a perspective view of a simplified caudal cycle fan.

The crank arm 8 is connected to the drive shaft of a motor (FIG. 1). The rotation drives one end of the connecting rod 6/blade 5 assembly on a circular path converting the rotational energy to essentially linear motion. The crank positions one end of the connecting rod 6 at a distance from the center of the drive source and rotates it about that center, thrusting and withdrawing the connecting rod 6/blade 5 assembly through the pivot bearing 7. The crank arm 8 offset diameter defines the depth of fluid to be driven and the mean angle of blade attack relative to the pivot bearing 7. The larger the crank offset, the further the crank arm 8 is from the pivot bearing 7, the larger the stream of fluid driven and the shallower the angle of attack. Shallow strokes are preferred for thin fluids or fluids driven at high speed. Long strokes with their inherent coarse angle of attack are for thicker or heavier fluids that need to be accelerated from a standstill. A crank arm 8 with a variable offset may be provided for a broader range of performance when needed. The crank arm 8 may be made from any rigid material such as cast iron, aluminum or plastic.

A motor 9 may be used to drive the crank arm 8 via a gear or belt assembly, however other sources of power such as a windmill or hand pumped or pedal lever connected to the crank arm 8 would also be effective.

The Connecting Rod

The connecting rod 6 connects the crank arm 8 to the blade 5 and transfers the power from the motor 9 to the blade 5 (FIG. 1). It is mounted securely to the blade 5 to resist the dynamic forces of the driving power and resistance of the driven fluid as well as deflecting and deforming forces introduced by blade cycle impediments. The connecting rod 6 may be made of a variety of materials that are able to overcome the stresses and loads of driving the specific volume of fluid performed by the device. Preferably the connecting rod is prepared from rod stock or cast metal.

The connecting rod 6 is mounted to the crank arm 8 so that it can rotate freely as the crank turns. This may be achieved with a cotter pin or the like, but is preferably a bearing in the connecting rod 6 that assures minimum friction while maintaining maximum planar rigidity. The connecting rod 6 may slide in and out of the pivot bearing 7 and pivot fore and aft to accommodate the motion extremes of the crank arm 8/connecting rod 6 joint. It may be designed to capture the pivot bearing 7 or be captured by the bearing, depending on the application.

The Bearing

The pivot bearing 7 converts the linear motion of the connecting rod 6 to a simplified caudal cycle motion (FIG. 1). The crank arm 8 rotates and plunges the connecting rod 6 in and out of the pivot bearing 7 mounted in the base or in the bottom of the encasement. It is aligned with the center of the crank arm 8 and limits the motion of the connecting rod 6 to the same plane as the crank rotation. The bearing accommodates the sliding in and out motion of the connecting rod 6 and the fore and aft motion imparted by the crank rotation. The resultant motion at the distal end of the connecting rod 6 is a truncated triangular path. The bearing minimizes play at the extreme fore and aft positions. Any looseness can cause excessive loading on the connecting rod and cause the blade to have extreme angles of attack, which impede the flow.

The pivot bearing 7 may be a ball bearing floating in a collar containing a hole to allow connecting rod 6 to slide in and out. Alternatively, if the connecting rod 6 is slotted, the pivot bearing 7 may be a pin on which the connecting rod 6 slides. These are only two examples of a sliding, pivoting joint but there are a number of similar connections known to those in the art that could be used. The selection of the desired pivot bearing will depend on the environment and special requirements of the application such as viscosity of the fluid, speed of movement and drag reduction.

Figure 5:
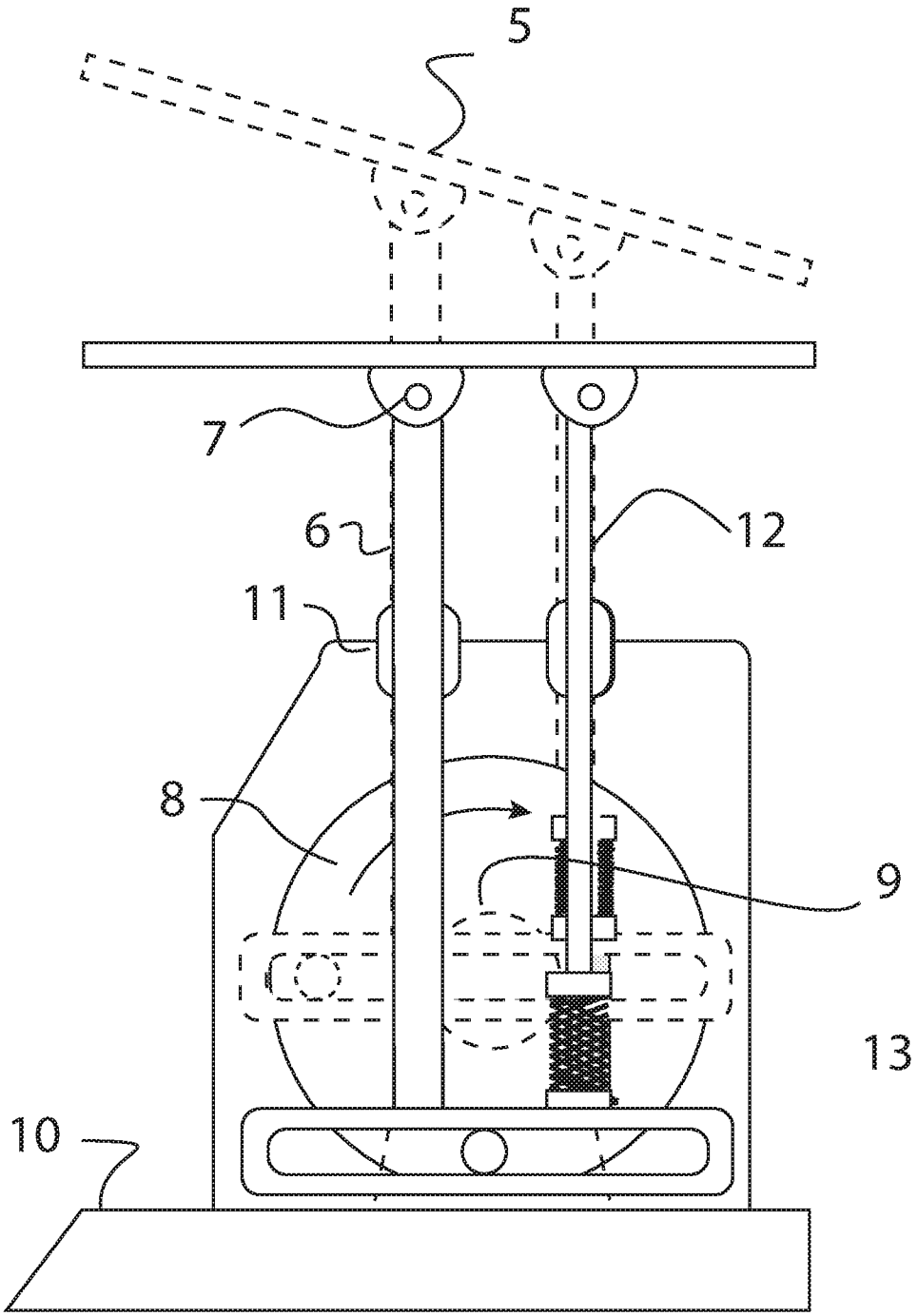
FIG. 5 is a sectional side view drawing of a mechanical caudal cycle linkage with a drive connecting rod and an angle of attack setting connecting rod. This angle of attack connecting rod adds a delay to the angle of attack with a spring that allows the trailing edge of the blade to lag behind the leading edge and maintain the correct angle of attack. Traditional angle of attack setting connecting rods are timed with a second crank a few degrees behind the driving crank giving a more precise angle of attack but being more expensive to construct.

In FIG. 5, the bearing is a slide bearing 11. This bearing maintains alignment of the rods 6 and 12 and allows them to move in and out through the housing 10 driving the desired motion of the blade 5.

The Driving Force

A motor 9 having a drive shaft provides the rotational energy to drive the crank arm 8 and is mounted securely to the base or encasement 10 (FIG. 1). In one embodiment, the motor 9 is an electric motor of an appropriate size for the application as well as to accommodate the speed, size and weight of the blade utilized. Alternatively, the motor may be a stepping motor that allows the blade 5 to be positioned at the top or bottom of the cycle preventing drag in a flowing system. It may also stop the blade 5 at a coarse angle to impede an existent flow. An internal combustion engine is suitable for some applications where reversing is not required and in low energy applications pedal or hand pump drives may be appropriate. The primary drive requirements are that the motive forces rotate the crank arm 8 at a suitable speed to operate the blade 5.

The Encasement/Base

The motor 9/crank arm 8 assembly is held securely in the encasement or base 10 relative to the pivot bearing 7 and fluid being moved through the system (FIG. 1). The encasement 10 is designed to resist the extended vibrational forces and protect the drive assembly from weather and tampering. In other embodiments the encasement 10 will additionally form a duct through which the fluid is or air is driven. The encasement 10 may further comprises a pipe, duct, conduit or canal to accommodate the air or fluid being transported. The pipe, duct, conduit or canal will have a size that does not interfere with the blades tip travel but of sufficient tolerance so that air or fluid cannot easily move around the perimeter of the blade. In some cases, the duct may only be necessary to control suction or discharge flow direction. Consequently, to protect the blade from foreign objects, precise ducting may be necessary if control and protection are important.

The assembly may be used to move fluid or things within a fluid. In both of these applications, ducting may be required. However, in all applications it is preferable that the encasement or base be securely mounted. This eliminates a significant amount of vibration resulting from moving fluids at slow speeds and dampens vibrations inherent in the device at higher speeds. One method to dampen vibration is to incorporate a counter weight on the crank arm 8. This may be accomplished by placing a counter weight on a spring mounted on the circumference of the crank arm 8.

Figure 3:
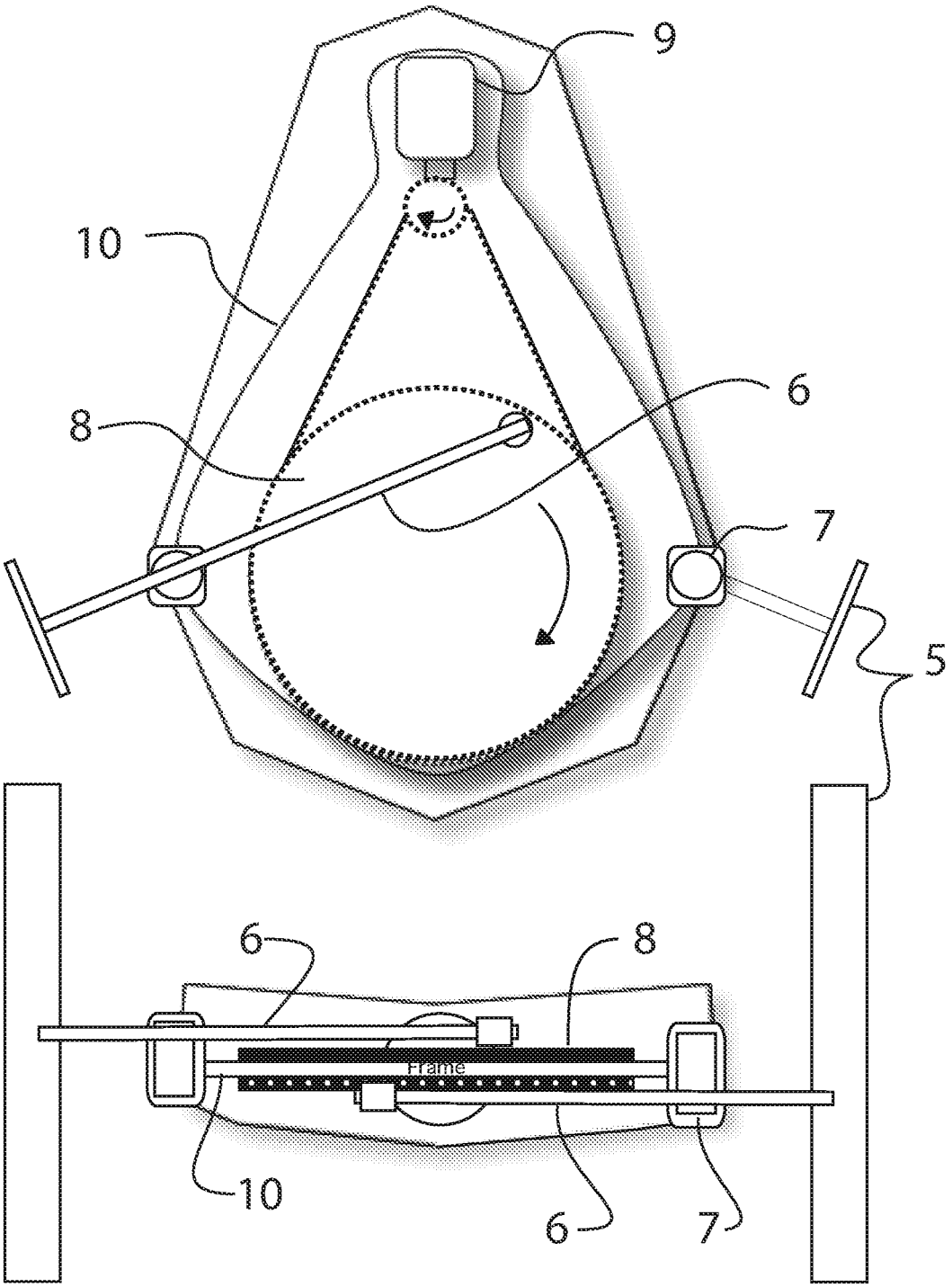
FIG. 3 is a diagrammatic representation of one example of a dual bladed simplified caudal cycle system.
Figure 4:
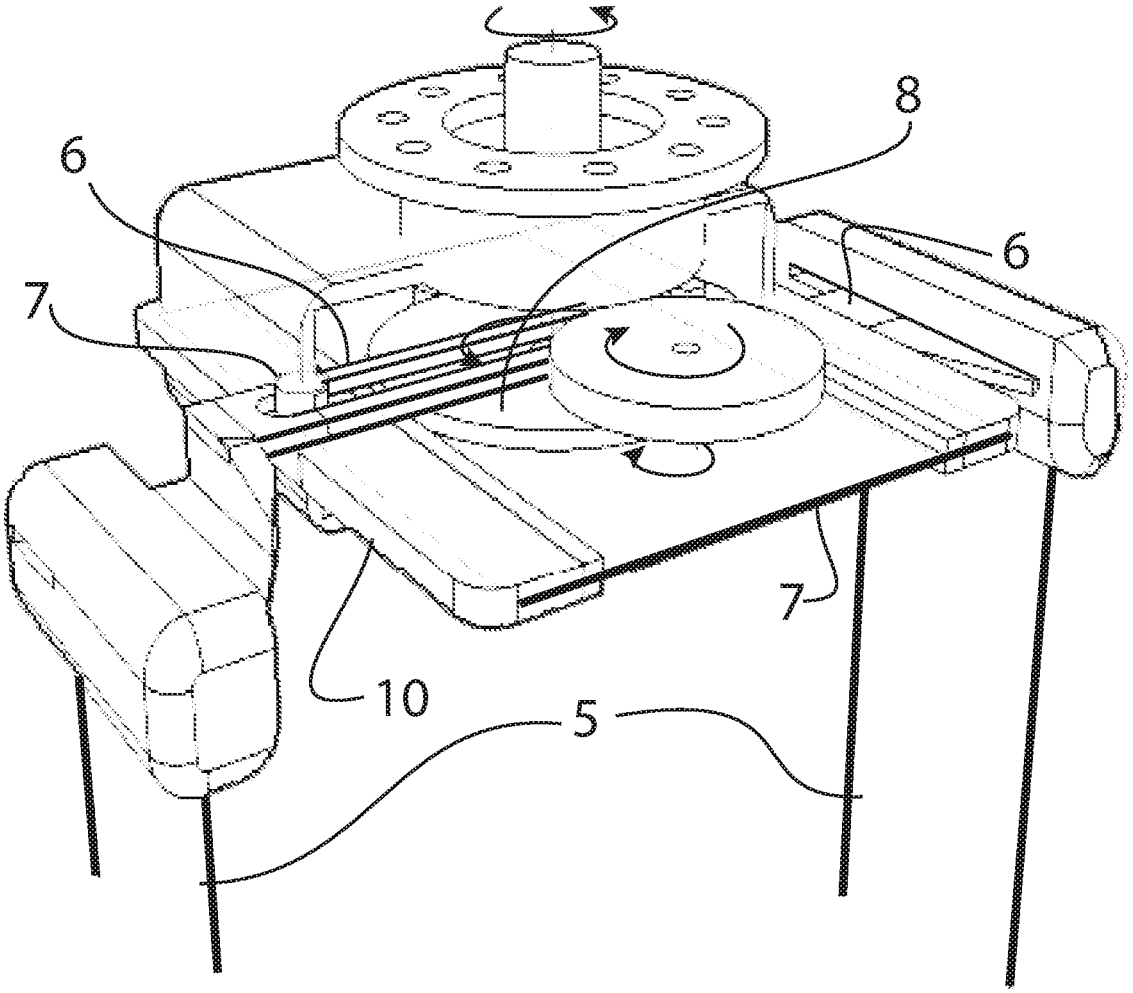
FIG. 4 is a diagrammatic representation of another example of a dual bladed simplified caudal cycle system.

A pair of blades 5 driven by counter-rotating crank arms 8 with pivot bearings 7 on opposite sides of the crank arm 8/drive assembly can eliminate vibration and give added performance by having each blade counter the other's thrust, eliminating blade slippage and fluid deflection (FIGS. 3 and 4).

A prototype fan was prepared and tested by measuring the air discharged during operation. The measurements indicated that the fan was moving air at a rate five times that of a fully engineered muffin fan of the same duct size. A hand placed in front of the device felt no turbulence, which is usually present in conventional fans. However with the simplified caudal cycle, the turbulence occurred at a distance of over two meters from the fan and duct assembly. The discharge was completely laminar and of significant volume and speed. Water tank testing of a fluid pump utilizing this technology also showed that water-moving characteristics are the same.

FIG. 5 shows a second connecting rod 12 to set the angle of attack and an adjustable spring 14 to absorb the energy of the drive connecting rod 6. The adjustable spring 14 provides a delay to the blade 5, setting an angle of attack just behind the angle set by the driving connecting rod 6.

Figure 6:
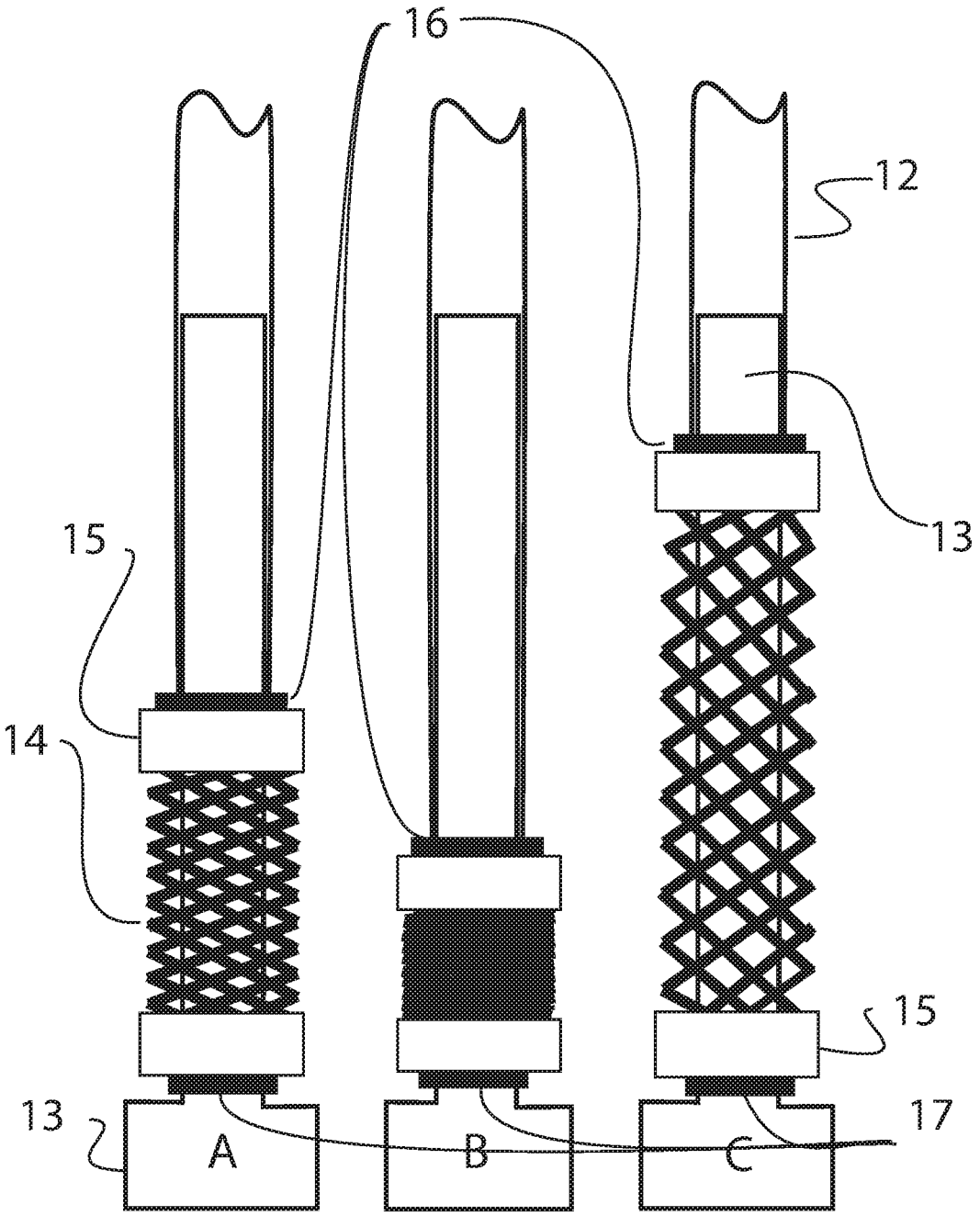
FIG. 6 shows the phases of the delay of the angle of attack setting connecting rod of FIG. 5, (A) at rest, (B) bottom of cycle going up and (C) top of cycle going down.

FIG. 6 shows details of the angle of attack connecting rod spring assembly having an anchored base 13 for the angle of attack connecting rod 12, spring 14, spring containment caps 15 and upper weldments 16 that secure the upper spring containment caps to the angle of attack connecting rod and lower weldments 17. The lower weldments 17 secure the lower spring containment caps to the anchored base for the angle of attack connecting rod 12. The angle of attack connecting rod 12 slides freely on the anchored base restrained only by the spring's 14 compression or expansion.

This construction (FIGS. 5 and 6), comprising a parallel blade is suitable for gasses in a fan configuration, where linear motion is desired in a more restricted space. The spring assembly also dampens vibration from high-speed use.

Use

The motor is connected to and rotates a crank with a throw equal to the amount of fluid flow desired. A connecting rod is attached to the crank disk and fed through a pivot bearing/pivot-bearing mount and connected to the blade at a single point about the center of the blade. It is anticipated that those skilled in the art would recognize that systems comprising multiple motors, connecting rods, pivot bearings and blades may be provided in configurations that address different design solutions.

Depending on its use as a fan, pump or propeller, the blade potion of the device is lowered into the fluid or gas stream and the motor started. As the fluid or gas stream is accelerated, the motor speed can be changed to further accelerate the fluid. Alternatively, if the motor speed is left constant, the fluid or gas will reach optimum speed for the blade design. If the blade is stopped at either crank extreme it will form a low drag situation and not impede the fluid or gas flow. If the blade is stopped at the halfway point it will provide maximum drag and slow the fluid or gas flow. Reverse the motor and the cycle of the blade will reverse and fluid will flow in the reverse direction.

The crank throw can be adjusted off center or closer to the center providing different pump characteristics. At close to center, or short throw, the pump becomes more of an impeller with less acceleration characteristics but less drag causing the fluid to travel at higher speed. At long throw, the fluid will accelerate more quickly to a given speed and accelerate a high-mass fluid more efficiently.

The further the pivot bearing is from the crank the less shallow the angle of attack and the less propelling acceleration will result. Closer distances provide a greater angle of attack and more acceleration. However, if the distance is too close, it will amplify the slack in the linkage, resulting in undue noise and accelerate wear.

When added performance is required, the system may be run at 3 to 4 times speed. This may result in increased noise and vibration if parts of the system are not in balance. A spring-loaded counter weight may be mounted on the crank equal to the loading weight on the blade to dampen most cycle loading vibration. If more than intermittent high-speed use is anticipated a counter thrusting blade (a two-blade system) may be used. To have both blades drive the fluid in the same direction, the cranks must be driven in opposite directions. This can be accomplished by different methods. If using a single motor, a pinion and two crown gears driving the cranks on a single axle may be utilized.

Having the connecting rod attached forward or aft of center can cause the fluid to accelerate more quickly, but this also puts more drag into the fluid flow at top speed. Consequently, this technique is preferable for highly viscosity or slow moving fluids.

Pumps

Using a device of the present invention for moving fluids is essentially the same as moving a gas, but all elements of the device will be more substantial to accommodate the heavier masses and viscosities (FIG. 1). The characteristics of the blade motion reduce fouling and are less likely to harm objects caught in its flow.

Fans

Using the device of the present invention for moving gases allows for a lighter construction in general. Moving smoke or explosive gasses may require explosion resistant motors or nonmetallic blades and even portability. Smaller devices used for air movement on circuit boards for example may have the motor positioned off to one side and an extended drive shaft to avoid having the motor interfere with the airflow. Likewise a room fan may have the motor in the base for stability. The assembly may also be oscillated to disperse the flow more broadly. Very large devices with blades 100 feet across or larger may be constructed for moving undesirable air contaminants such as smog or smoke from communities. Alternatively, a device of this size may be used as a counter wind for wildfire control situations. Similarly pushing a warmed breeze over crops during a potential frost may prevent weather losses.

Propellers

Conventional propellers have the disadvantage of corroding over time. This occurs during use when the pressure on or around a traditional foil-bladed propeller blade reduces enough to equal the vapor pressure of the fluid. Under this condition the liquid state is no longer sustainable and molecules vaporize forming cavities, or bubbles of hydrogen and oxygen. When these gasses come in contact with each other they cause a microscopic explosive reaction with temperature exceeding 2,000° F. causing pitting and erosion. The bubbles also distort flow patterns that reduce efficiency. The laminar surface flow of the present technology eliminates these problems providing longer blade life and reducing the cost of maintenance and operation.

A device of the present invention for moving objects through a gas or liquid, such as an aircraft or boat propeller, may be configured with a pair of blades thrusting in the same direction (FIGS. 3 and 4). However, having two separate devices mounted port and starboard is preferred when the sides are too far apart for a single drive dual bladed embodiment. This model allows counter thrusting for steering in tight quarters. The single motor dual blade embodiment may be directionally positioned to provide thrust in all desired directions for driving, steering, trim and tight maneuvering eliminating the need for rudders, thrusters or reversing gears.

The information set forth above is provided to give those of ordinary skill in the art a complete disclosure and description of how to make and use the embodiments of the device and methods, and are not intended to limit the scope of what the inventor regards as his invention. Modifications of the above-described modes (for carrying out the invention that are obvious to persons of skill in the art) are intended to be within the scope of the following claims. All publications, patents, and patent applications cited in this specification are incorporated herein by reference.

What is claimed is:

1. A device for propelling objects using a caudal cycle comprising:

a. at least one flat planar rigid blade having an upper surface and a lower surface that do not intersect, the at least one flat planar rigid blade having an angle of attack for moving gas or liquid;

b. at least one crank for each of said at least one flat planar rigid blade having a first aperture and a second aperture, said first aperture able to receive a drive shaft, said second aperture at a set distance away from the first aperture;

c. at least one connecting rod for each of said at least one flat planar rigid blade affixed on one end to a center of the upper surface of said flat planar rigid blade and the other end affixed to the second aperture of said at least one crank;

d. an encasement having at least one opening, said at least one connecting rod for each of said at least one flat planar rigid blade passing through said at least one opening; and e. at least one bearing affixed within said at least one opening of said encasement through which said at least one connecting rod passes, wherein a distance between said at least one bearing and said at least one crank determines the angle of attack of said at least one flat planar rigid blade; said at least one connecting rod adding a delay to the angle of attack when the device is moving gas or liquid, said at least one connecting rod adding the delay with a spring that allows a trailing edge of said at least one flat planar rigid blade to lag behind a leading edge and maintain the angle of attack; said at least one bearing converting linear motion of said at least one connecting rod to caudal cycle motion when the device is moving gas or liquid; and said drive shaft providing rotational energy to drive the at least one crank when the device is moving gas or liquid.

2. The device according to claim 1, wherein said drive shaft is a motor drive shaft.

3. The device according to claim 1, wherein said encasement is a gas or fluid conduit into which said at least one flat planar rigid blade extends.

4. The device according to claim 1, further comprising a motor having said drive shaft.

5. The device according to claim 4, wherein said encasement is a housing that encases said motor, said at least one crank and the portion of said at least one connecting rod affixed to said crank.

6. The device according to claim 1, wherein the upper surface and the lower surface are parallel.

7. The device according to claim 6, wherein the leading edge and the trailing edge are bluff.

8. The device according to claim 1, wherein said at least one flat planar rigid blade is formed from bronze, aluminum, carbon fiber, rigid plastic, or steel.

9. The device according to claim 1, wherein the spring is adjustable to set the angle of attack. rod affixed to said crank.

10. A device for moving an object through water comprising:

a. a first flat planar rigid blade and a second flat planar rigid blade each having an upper surface and a lower surface that do not intersect, and each having an angle of attack for moving the water;

b. a first crank and a second crank, said first crank controlling said first flat planar rigid blade, said second crank controlling said second flat planar rigid blade, each crank having a first aperture and a second aperture, said first aperture able to receive a drive shaft, said second aperture at a set distance away from said first aperture and said second aperture of said first crank offset 180° from said second aperture of said second crank;

c. a first connecting rod and a second connecting rod, said first connecting rod affixed on one end to a center of the upper surface of said first flat planar rigid blade and the other end affixed to the second aperture of said first crank, said second connecting rod affixed on one end to the center of the upper surface of said second flat planar rigid blade and the other end affixed to said second aperture of said second crank;

d. an encasement having two openings, said first connecting rod passing through one opening and said second connecting rod passing through the other opening; and e. a first pivot bearing and a second pivot bearing, one affixed within each of said two openings of said encasement through which said connecting rods pass, wherein a distance between the first pivot bearing and the first crank determines the angle of attack of the first flat planar rigid blade, and a distance between the second pivot bearing and the second crank determines the angle of attack of the second flat planar rigid blade;

wherein said first and second connecting rods add a delay to the angle of attack of the first flat planar rigid blade and the angle of attack of the second flat planar rigid blade when the device is moving the object through the water with corresponding first and second springs that allow trailing edges of said first and second flat planar rigid blades to lag behind leading edges of said first and second flat planar rigid blades and maintain the angle of attack of the first flat planar rigid blade and the angle of attack of the second flat planar rigid blade;

wherein said first and second bearings convert linear motion of said first and second connecting rods to caudal cycle motion when the device is moving the object through the water; and wherein said drive shaft provides rotational energy to drive said first and second cranks when the device is moving the object through the water.

11. The device according to claim 10, wherein said encasement is a gas or fluid pipe into which said first flat planar rigid blade and said second flat planar blade extends.

12. The device according to claim 10, wherein said encasement is a housing that encases a motor, said crank and the portion of said connecting rod affixed to said crank.

13. The device according to claim 10, wherein the upper surface and the lower surface are parallel.

14. The device according to claim 13, wherein the leading edges and the trailing edges are bluff.

15. The device according to claim 10, wherein said first and second flat planar rigid blades are formed from bronze, aluminum, carbon fiber, rigid plastic, or steel.

16. A method of propelling objects using a caudal cycle comprising the steps of:

a. providing a device comprising: at least one flat planar rigid blade having an upper surface and a lower surface that do not intersect; a crank for each of said at least one flat planar rigid blade having a first aperture and a second aperture, said second aperture at a set distance away from the first aperture; a motor having a drive shaft affixed to said first aperture of said crank; a connecting rod for each of said at least one flat planar rigid blade affixed on one end to a center of the upper surface of said flat planar rigid blade and the other end affixed to the second aperture of said crank; an encasement having at least one opening, said connecting rod for each of said at least one flat planar rigid blade passing through said at least one opening; and a pivot bearing affixed within said at least one opening of said encasement through which the connecting rod passes;

b. positioning at least one bearing at a distance from at least one crank to determine an angle of attack of the at least one flat planar rigid blade;

c. inserting said at least one flat planar rigid blade of said device into said gas or liquid; and d. activating said motor; wherein:

said connecting rod adds a delay to the angle of attack with a spring that allows a trailing edge of said at least one flat planar rigid blade to lag behind a leading edge and maintain the angle of attack;

said bearing converts linear motion of said connecting rod to caudal cycle motion; and said drive shaft provides rotational energy to drive said crank.

17. A device for propelling objects using a caudal cycle comprising:

a. at least one flat planar rigid blade having an upper surface and a lower surface that do not intersect, the at least one flat planar rigid blade having an angle of attack for moving gas or liquid;

b. at least one crank for each of said at least one flat planar rigid blade having a first aperture and a second aperture, said first aperture able to receive a drive shaft, said second aperture at set distance away from the first aperture;

c. at least one first connecting rod for each of said at least one flat planar rigid blade affixed on one end to a center of the upper surface of said flat planar rigid blade and the other end affixed to the second aperture of said crank;

d. at least one second connecting rod for each of said at least one flat planar rigid blade affixed on one end to a second location on the upper surface of said flat planar rigid blade and the other end affixed to an anchored base, said at least one second connecting rod including an adjustable spring configured to set the angle of attack;

e. an encasement having at least two openings, said first connecting rod and said second connecting rod passing through said at least two openings; and f. at least two sliding-bearings affixed within said at least two openings of said encasement through which the connecting rods pass;

wherein a distance between said bearings and said at least one crank determines the angle of attack of said at least one flat planar rigid blade; said at least one second connecting rod adding a delay to the angle of attack when the device is moving gas or liquid, said at least one connecting rod adding the delay with the adjustable spring that allows a trailing edge of said at least one flat planar rigid blade to lag behind a leading edge and maintain the angle of attack; said bearings converting linear motion of said at least one first connecting rod and at least one second connecting rod to caudal cycle motion when the device is moving gas or liquid; and said drive shaft providing rotational energy to drive the at least one crank when the device is moving gas or liquid.

18. The device according to claim 17, wherein said flat planar rigid blade is formed from bronze, aluminum, carbon fiber, rigid plastic, or steel.

19. The device according to claim 17, wherein said flat planar rigid blade reduces shedding vortices in an exhaust flow.

* * * * *